United States Patent [19]

Cotman et al.

[11] 4,316,120

[45] Feb. 16, 1982

[54] CIRCULAR FLUORESCENT LAMP UNIT

[75] Inventors: Ronald N. Cotman, Chesterland; Gustino J. Lanese, South Euclid, both of Ohio

[73] Assignee: General Electric Company, Schenectady, N.Y.

[21] Appl. No.: 199,495

[22] Filed: Oct. 22, 1980

Related U.S. Application Data

[63] Continuation of Ser. No. 47,988, Jun. 13, 1979, abandoned.

[51] Int. Cl.[3] ..... H01J 7/44; H01J 17/34; H01J 19/78; H01K 1/62

[52] U.S. Cl. ..... 315/58; 313/51; 313/493; 339/50 C; 362/216

[58] Field of Search ..... 313/493, 220, 318, 51; 339/50 R, 50 C, 144 R; 315/49, 58; 362/216

[56] References Cited

U.S. PATENT DOCUMENTS

| | | | |
|---|---|---|---|
| 2,298,961 | 10/1942 | Miller | 176/122 |
| 2,339,166 | 1/1944 | Harrison | 313/51 X |
| 2,344,122 | 3/1944 | Bay et al. | 315/49 |
| 2,472,597 | 6/1949 | Levy | 313/51 X |
| 2,525,022 | 10/1950 | Dupuy | 240/51.12 |
| 2,534,956 | 12/1950 | Pistey et al. | 339/50 C |
| 2,626,346 | 1/1953 | Stoller et al. | 240/51.12 |
| 2,652,483 | 9/1953 | Laidig et al. | 339/50 C |
| 2,878,372 | 3/1959 | Fry | 240/51.12 |
| 3,059,137 | 10/1962 | Reaves | 313/204 |
| 3,107,316 | 10/1963 | McIlvaine | 315/248 |
| 3,611,009 | 10/1971 | McNeil | 313/318 |
| 3,742,208 | 6/1973 | Mills | 240/51.12 |
| 3,899,712 | 8/1975 | Witting | 313/493 |
| 3,953,761 | 4/1976 | Giudice | 315/71 |
| 4,002,394 | 1/1977 | Cordiano et al. | 339/50 C |
| 4,093,974 | 6/1978 | Wheeler | 339/50 C |
| 4,244,013 | 1/1981 | Wotowiec | 362/216 |

FOREIGN PATENT DOCUMENTS

| | | | |
|---|---|---|---|
| 2205349 | 10/1973 | Fed. Rep. of Germany | 339/50 C |

*Primary Examiner*—Saxfield Chatmon, Jr.
*Attorney, Agent, or Firm*—Norman C. Fulmer; Lawrence R. Kempton; Philip L. Schlamp

[57] ABSTRACT

A circular fluorescent lamp unit having a compact central hub containing a ballast reactor and provided with a screw base. A replaceable circular lamp assembly is positioned around and attached to the hub.

6 Claims, 7 Drawing Figures

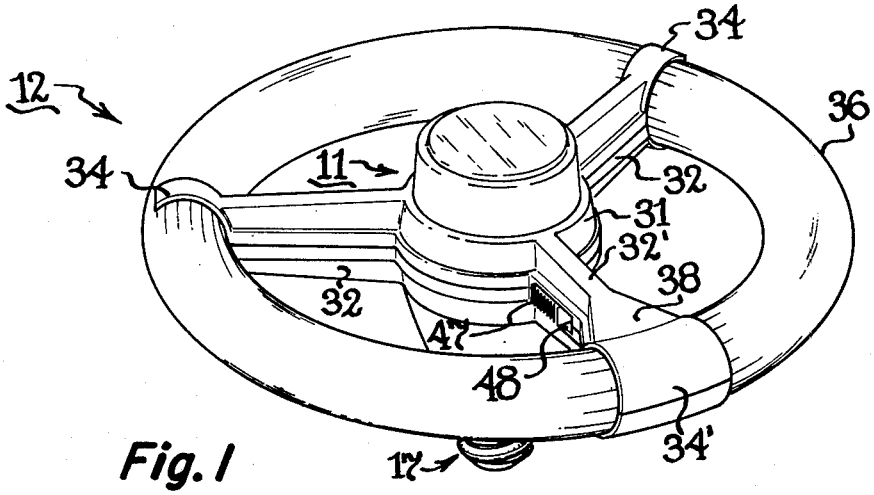
Fig. 1
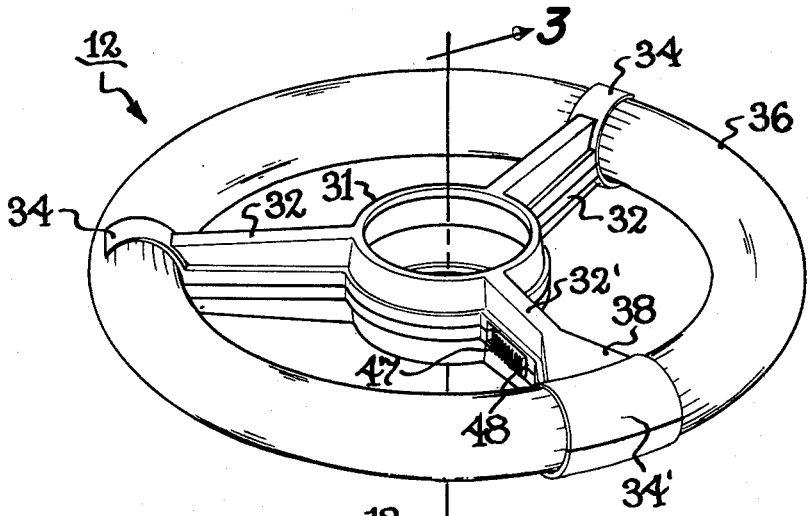
Fig. 2
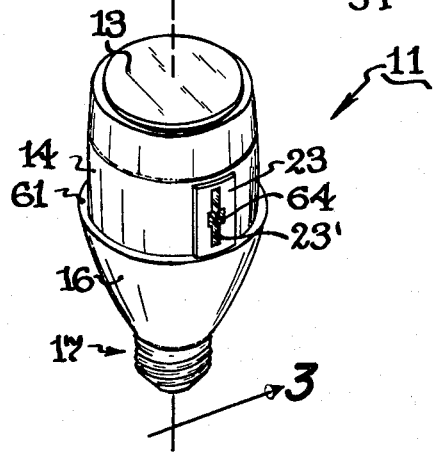

Fig. 3a
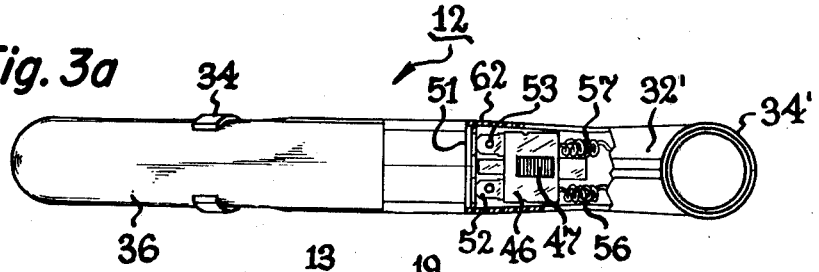
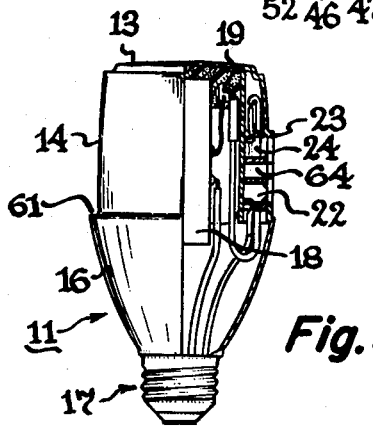
Fig. 3b
Fig. 4
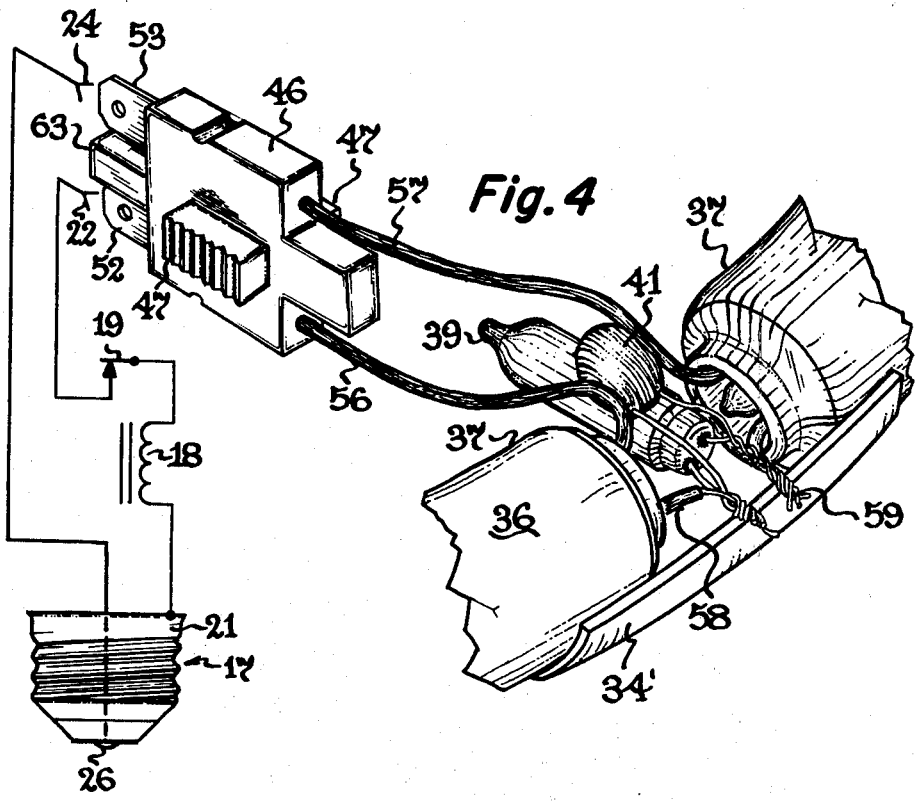

CIRCULAR FLUORESCENT LAMP UNIT

CROSS-REFERENCES TO RELATED APPLICATIONS

This is a continuation of application Ser. No. 47,988, filed June 13, 1979, now abandoned.

Ser. No. 47,986, now U.S. Pat. No. 4,258,287, Frederick Hetzel, "Circular Fluorescent Lamp Unit", filed concurrently herewith and assigned the same as this invention.

Ser. No. 47,987, Neil E. Collins, "Circular Fluorescent Lamp Unit", filed concurrently herewith now abandoned, and assigned the same as this invention.

Ser. No. 47,985, now U.S. Pat. No. 4,278,911 Rudolph Metoff, "Circular Fluorescent Lamp Unit", filed concurrently herewith and assigned the same as this invention.

Ser. No. 944,650, Joseph P. Wotowiec, "Circular Fluorescent Light Unit", filed Sept. 21, 1978 and assigned the same as this invention.

BACKGROUND OF THE INVENTION

The invention is in the field of circular lamp units, such as screw-in units having a circular fluorescent lamp and a ballast reactor.

Various types of screw-in circular fluorescent lamp units have been devised, for use in ceiling sockets and in table lamps and floor lamps. A typical unit has a central housing containing a ballast reactor and provided with a screw base, and a circular fluorescent lamp surrounds the reactor housing and is held thereby by means of brackets or spokes attached to and extending from the housing. When screwing the lamp unit into the socket of a floor or table lamp having a harp which supports a lamp shade, the harp must be removed while the lamp unit is being screwed into the socket, whereupon the lamp is re-attached by inserting it between or among the lamp unit's brackets or spokes. This is necessitated by the harp being dimensioned to flank an incandescent type of of light bulb, whereas the circular fluorescent lamp is considerably larger in diameter. The circular fluorescent lamp unit is somewhat heavy because of the weight of the reactor, and because of this and the surrounding structure of the circular lamp and its support brackets it is somewhat awkward and difficult to screw it into a socket and also to unscrew it from a socket.

SUMMARY OF THE INVENTION

A principal object of the invention is to provide an improved screw-in circular fluorescent lamp unit that is attractive in appearance and is easy to attach to and remove from lamp sockets.

The invention comprises, briefly and in a preferred embodiment, a circular lamp unit having a compact central hub containing a ballast reactor and provided with a screw base. A replaceable circular lamp assembly has a sleeve ring which fits around the central hub, and spokes radiate from the sleeve ring to hold a circular fluorescent lamp.

BRIEF DESCRIPTION OF THE DRAWING

FIG. 1 is a top perspective view of a preferred embodiment of invention.

FIG. 2 is a view similar to FIG. 1, but with the circular lamp assembly separated from the central hub.

FIG. 3*a* is a side view of the circular lamp assembly, shown partly broken away to show interior construction.

FIG. 3*b* is a side view of the central hub unit, partly broken away to show the interior construction.

FIG. 4 is a perspective view of a portion of the circular lamp assembly, along with a schematic diagram of the contents of the central hub.

DESCRIPTION OF THE PREFERRED EMBODIMENT

Figure 5:
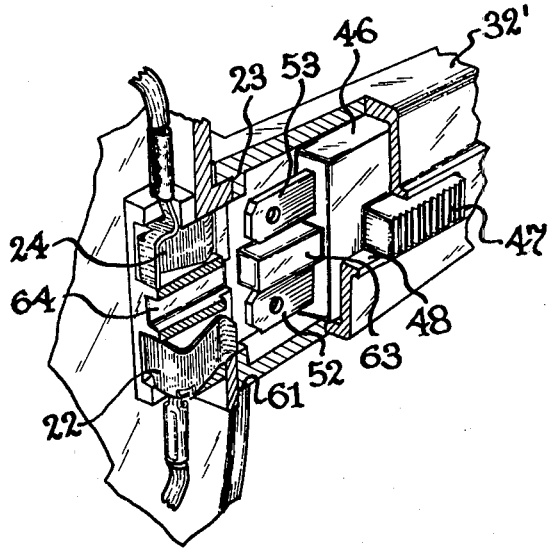
FIGS. 5 and 6 are broken away perspective views of the lamp unit, showing its slide connector in disengaged position and in engaged position, respectively.

The circular lamp unit comprises a compact central hub unit 11 and a circular lamp assembly 12 which is replacable on the hub 11. The hub 11 comprises a plastic housing 13 having a cylindrical portion 14 and a tapered section 16 at the small end of which is attached a threaded screw base 17. As shown in FIGS. 3*b* and 4, a ballast reactor 18 and thermal circuit breaker 19 are contained within the housing 13 and are electrically connected in series between the threaded base shell 21 and an electrical contact 22 of a raised socket 23 which projects from the side of the cylindrical portion 14 of the hub 11. The thermal circuit breaker 19 is positioned adjacent to the ballast reactor 18 and is designed to open the electrical circuit in the event of over heating of the ballast reactor 18. Other types of ballasts, such as a resistor or electronic circuit, can be used instead of a reactor. A second socket contact 24 is electrically connected to the button terminal 26 of the threaded base 17. The two socket contacts 22 and 24 are aligned parallel to the axis of the hub 11 and are recessed in a narrow slot 23' for electrical safety. The electrical wiring connections to the base shell 21 and button terminal 26 can be interposed, and the thermal circuit breaker 19 can be located elsewhere in the wiring within the hub 11 if desired.

The circular lamp assembly 12 comprises a sleeve ring 31 which removably slides over and surrounds the cylindrical portion 14 of the hub 11. A plurality of spokes 23 extend outwardly from the sleeve ring 31 in a symmetrical manner, and terminate with clamp arms 34 which may fully or partially surround a circular lamp or light bulb 36 and hold it in a coaxial relationship with respect to the sleeve ring 31. The assembly of the sleeve ring 31, spokes 32 and clamp arms 34 may comprise two substantially similar upper and lower plastic parts which are assembled together with their clamp arms 34 positioned against the upper and lower sides of the circular lamp 36, and may be fastened together by means of tight fitting fastening tabs, or cement. One of the spokes 32' is provided with an enlarged pair of clamp arms 34' so as to also function as a connector housing which fits around and conceals the end regions 37 of the lamp 36, and associated wiring thereof, as will be described and which is best shown in FIG. 4. The spokes 32 may be relatively thin in horizontal crosssection, and may have a vertical height dimension as disclosed and claimed in the above referenced Wotoweic patent application. The spoke 32', which terminates at a housing 34' surrounding the ends 37 of the circular lamp, may be provided with an enlarged hollow tapered region 38 adjacent to the connector housing 34', to help facilitate accomodation of a glow starter switch 39 and associated capacitor 41 as is disclosed and claimed in the above referenced Collins patent.

As is disclosed and claimed in the above referenced Metoff patent application, a slide connector 46 is provided within the spoke 32', and is adapted to slide along the axis of spoke 32' and toward or away from the hub 11. A pair of finger grips 47 extend from opposite sides of the slide connector 46 and through openings 48 in the sides of the spoke 32', so they can be gripped by a person's thumb and finger for manually sliding the connector 46 toward or away from the hub 11. The slide connector 46 and its finger grips 47 can be integrally molded from plastic or rubber. A vertical slot 51 at the inside of the sleeve ring 31 mates with the raised socket 23 of the hub 11, for preventing the lamp assembly 12 from rotating on the hub 11, and for also aligning the lamp assembly spoke 32' with the socket 23 of the hub. A pair of electrical connector prongs 52, 53 extend from the slide connector 46 toward and respectively in alignment with the socket contacts 22 and 24. The slide connector 46 can be manually moved far enough away from the hub 11 so that the tips of the prongs 52 and 53 will not touch nor interfere with the sliding insertion of the lamp assembly 12 over and around the cylindrical portion 14 of the hub 11, whereupon the slide connector 46 is manually moved toward the hub 11 so that its connector prongs 52 and 53 enter into the hub socket 23 and engage its contacts 22 and 24, respectively. A pair of flexible wires 56, 57 are attached to the connector prongs 52 and 53, respectively, and the other ends of the wires 56 and 57 are respectively connected to lead wires at respective ends 37 of the circular lamp 36, each of these lead wires being respectively connected to the end of a filament in each of the two ends of the lamp 36. These filaments are conventional and are not shown in the drawing. The lamp starting switch 39 is electrically connected to the lamp 36 lead wires 58 and 59 which are respectively connected to the remaining ends of the filaments of the lamp 36. The capacitor 41 is electrically connected across the starting switch 39, to reduce the ratio interferrence emissions.

Figure 6:
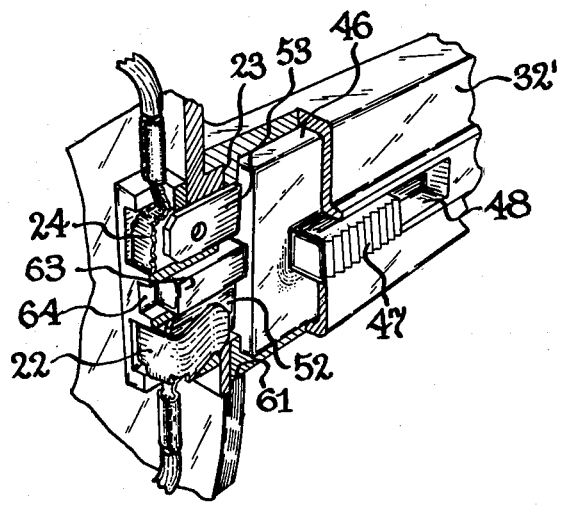

FIG. 5 illustrates the position of the slide connector 46 when it is retracted, for insertion of the circular lamp assembly onto, or removal from, the hub 11. FIG. 6 shows the arrangement of the invention with the slide connector 46 in its operating position, with the electrical prongs 52 and 53 inserted into the socket 23 and in engagement with socket contacts 22 and 24, whereby the hub 11 and lamp assembly 12 provide an integral operational lamp unit. An outwardly extending flange 61 around the bottom portion of the cylindrical hub part 14 faciltates initial positioning of the sleeve ring 32 with respect to the socket 23, for the aforesaid insertion of the connector prong 52 and 53 into the socket, in cooperation with the aforesaid mating of the extended socket 23 and slot 51 in the sleeve ring, for preventing rotational relative motion. The aforesaid positioning of the said lamp assembly on the hub 11 can further be facilitated by providing a sleeve ring slot 51 which extends not quite fully to the upper inner surface of the sleeve ring 31, as illustrated by the numeral 62 in FIG. 3A. The mechanical connection of the lamp assembly 12 to the hub 11 is facilitated by providing a locking prong 63 extending from the slide connector 46 toward the hub 11, and located between the connector prongs 52 and 53; this locking prong mates into a suitable opening 64 in the center region of the socket 23. The locking prong 63 can be molded integrally with slide connector 46.

The lamp unit of the invention is easily placed in a socket, by first screwing the base of hub 11 into the socket. This is easily done, because of the compact and circular shape of the hub. Then the lamp assembly 12 is slid over and around the cylindrical portion 14 of the hub, and the slide connector 46 is moved toward the hub to complete the electrical and mechanical connection as described above. To easily remove the lamp unit, the foregoing steps are repeated in reverse order. To replace the lamp assembly, the slide connector 46 is moved away from the hub 11, the lamp assembly is lifted off the hub, and a new lamp assembly is placed on the hub as has been described. To place the lamp unit of the invention in a floor or table lamp having a shade supported by a harp, the shade and harp are removed, and only the hub 11 is easily screwed into the socket, as described above. The circular lamp assembly 12 is then slid over and around the hub and the slide connector 46 is moved toward the hub to complete the connections. The harp is the placed through spaces between spokes 32 and reconnected, and the shade is reconnected to the harp. The overall diameter of the hub 11 and sleeve ring 31 can be made about the same or smaller than that of a conventional incandescent light bulb used in table and floor lamps, and the inner diameter of the circular light bulb 36 is larger than the width of conventional lamp harps.

The invention provides a convenient and effective means for screwing the lamp unit into a socket, such as the socket of a lamp having a shade and harp arrangement, and also to facilitate easy removal of the unit, because it is easier to handle and manipulate the compact cylindrical hub than the entire assembly including spokes or brackets extending from the hub.

While preferred embodiments of the invention have been shown and described, various other embodiments and modifications thereof will become apparent to persons skilled in the art, and will fall within the scope of the invention as defined in the following claims.

What we claim as new and desire to secure by Letters Patent of the United States is:

1. A circular lamp unit comprising a central hub and a detachable circular lamp assembly, said hub having an outside diameter of given size and comprising means for connection to a source of electrical power and said circular lamp assembly comprising a circular light bulb having an inside diameter larger than said diameter of the central hub, attachment means for surrounding and providing detachable connection to said hub, and a plurality of individual spokes extending outwardly from said attachment means and supporting said circular light bulb, said spokes defining spaces therebetween through which a lamp harp can pass, said circular lamp assembly being an integral replaceable unit, and said hub containing ballast means for said light bulb.

2. A lamp unit as claimed in claim 1, in which said attachment means comprises a sleeve ring surrounding said hub.

3. A lamp unit as claimed in claim 2, in which said hub is cylindrical and said sleeve ring has a circular cross-section.

4. A hub for a circular lamp unit, comprising a housing containing a ballast and provided with an electrical connector base at an end thereof, said housing being devoid of spokes or brackets attached thereto and extending therefrom for holding a lamp.

5. A hub as claimed in claim 4, in which said housing is cylindrical.

6. An integral and replaceable circular lamp assembly for connection to a hub containing a ballast, comprising a circular light bulb having an inside diameter larger than that of said hub, attachment means for surrounding and providing detachable connection of said lamp assembly to said hub, and a plurality of individual spokes extending outwardly from said attachment means and supporting said circular light bulb, said spokes defining spaces therebetween through which a lamp harp can pass.

* * * * *